US010295944B2

(12) United States Patent
Hiroi

(10) Patent No.: US 10,295,944 B2
(45) Date of Patent: May 21, 2019

(54) IMAGE FORMING APPARATUS WHICH DETERMINES WHETHER IMAGE FORMING PART IS IN STABLE OR UNSTABLE STATE AND CONTROL METHOD FOR IMAGE FORMING APPARATUS

(71) Applicant: Konica Minolta, Inc., Tokyo (JP)

(72) Inventor: Toshiaki Hiroi, Okazaki (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/966,741

(22) Filed: Apr. 30, 2018

(65) Prior Publication Data

US 2018/0335739 A1 Nov. 22, 2018

(30) Foreign Application Priority Data

May 19, 2017 (JP) ..... 2017-099836

(51) Int. Cl.

*G03G 15/00* (2006.01)
*G03G 21/20* (2006.01)
*G03G 21/16* (2006.01)

(52) U.S. Cl.

CPC ..... *G03G 15/5054* (2013.01); *G03G 15/5037* (2013.01); *G03G 15/55* (2013.01); *G03G 15/553* (2013.01); *G03G 15/5045* (2013.01); *G03G 21/168* (2013.01); *G03G 21/203* (2013.01)

(58) Field of Classification Search

CPC ..... G03G 15/161; G03G 15/162; G03G 15/5054; G03G 21/168; G03G 21/203; G03G 2215/1623; G03G 15/55; G03G 15/5037

USPC ..... 399/31, 44, 66, 302, 308

See application file for complete search history.

(56) References Cited

U.S. PATENT DOCUMENTS 6,324,355 B1 * 11/2001 Matsui ..... G03G 15/0194 399/167
6,993,276 B2 * 1/2006 Kamiya ..... G03G 15/0131 399/300
7,197,256 B2 * 3/2007 Nishizaki ..... G03G 15/0131 399/396
8,208,842 B2 * 6/2012 Hashimoto ..... G03G 15/0194 399/162

(Continued)

FOREIGN PATENT DOCUMENTS

JP S60-069663 A 4/1985
JP 08160813 A * 6/1996

(Continued)

*Primary Examiner* — Robert B Beatty
(74) *Attorney, Agent, or Firm* — Lucas & Mercanti, LLP

(57) ABSTRACT

An image forming apparatus includes: an image former having parts provided in a replaceable manner to be used for image formation; a sensing part that detects a characteristic value of the parts; and a controller that determines whether the characteristic value of the parts, which fluctuates immediately after manufacture, is in a stable state based on a comparison between information regarding the characteristic value of the parts based on a detection result of the sensing part and a threshold value and sets a process condition for the image former based on the detected characteristic value when determining that the characteristic value of the parts is not in the stable state.

14 Claims, 9 Drawing Sheets

(56) References Cited

U.S. PATENT DOCUMENTS

2003/0147658 A1* 8/2003 Shin ..... G03G 15/065
399/26

FOREIGN PATENT DOCUMENTS

| | | | | |
|---|---|---|---|---|
| JP | H08-171329 | A1 | | 7/1996 |
| JP | 09179459 | A | * | 7/1997 |
| JP | H11-084823 | A | | 3/1999 |
| JP | 2001255760 | A | * | 9/2001 |
| JP | 2007079497 | A | * | 3/2007 |
| JP | 2010224497 | A | * | 10/2010 |
| JP | 2016004056 | A | | 1/2016 |

* cited by examiner

IMAGE FORMING APPARATUS WHICH DETERMINES WHETHER IMAGE FORMING PART IS IN STABLE OR UNSTABLE STATE AND CONTROL METHOD FOR IMAGE FORMING APPARATUS

The entire disclosure of Japanese patent Application No. 2017-099836, filed on May 19, 2017, is incorporated herein by reference in its entirety.

BACKGROUND

Technological Field

The present disclosure relates to an image forming apparatus having replaceable parts.

Description of the Related Art

Generally, an image forming apparatus (printer, copying machine, facsimile, and the like) using an electrophotographic process technology irradiates (exposes) a charged photoconductor with laser light based on image data, thereby forming an electrostatic latent image. Then, toner is supplied from a developing device to the photoconductor on which the electrostatic latent image is formed, whereby the electrostatic latent image is visualized to form a toner image. Furthermore, after this toner image is directly or indirectly transferred to a sheet, the toner image is formed on the sheet by heating and pressurizing the toner image at a fixing nip to fix.

Conventionally, in this type of image forming apparatus, parts provided in a replaceable manner are ensured to have a sufficient retention period after manufacture and are often used in a state where their characteristics are stable.

Since these parts are used in a state where their characteristics are stable, generally, output control is performed according to long-term characteristic fluctuations due to durability and characteristic fluctuations caused by an environmental change (JP 60-69663 A, JP 8-171329 A, JP 11-84823 A, and JP 2016-4056 A).

For example, in the case of a transfer belt, control is performed, for example, in such a manner that transfer output is corrected by detection of transfer belt resistance when the environment varies by a certain level or more, or transfer output is corrected by detection of transfer belt resistance at constant intervals of a durable number of sheets.

However, in order to secure a sufficient retention period after manufacture, retention expenses for a retention space and the like arise and earlier shipment is desired from the viewpoint of cost reduction.

As a result, there is a possibility that replaceable parts are shipped in a state immediately after manufacture, where the characteristics of parts are unstable.

In this respect, for example, in regard to the transfer belt by an atmospheric glow plasma (AGP) treatment, since there are many unreacted groups immediately after film creation for an AGP layer, the unreacted groups tend to react with moisture and there is a possibility that the resistance characteristic of the AGP layer varies due to moisture absorption.

As the transfer belt by the AGP treatment, polyphenylene sulfide (PPS) obtained by dispersing carbon as a conductive material is used as a base material. In addition, a description will be given on an endless belt having a two-layer structure in which an inorganic oxide thin film layer is provided on a base material by a plasma chemical vapor deposition (CVD) method for the purpose of improving transferability.

In a case where constant-voltage transfer output control is executed on the transfer belt by the AGP treatment having a short retention period, there is a possibility that the transfer belt deviates from a proper output setting due to a change in the resistance characteristic, resulting in an image defect arising due to poor transferability (transfer defect or white spot).

SUMMARY

The present disclosure is directed to solving the above-described problems, and an object thereof is to provide an image forming apparatus and a control method for the image forming apparatus capable of setting an appropriate process condition even when a characteristic value of parts is not in a stable state immediately after manufacture.

To achieve the abovementioned object, according to an aspect of the present invention, an image forming apparatus reflecting one aspect of the present invention comprises: an image former having parts provided in a replaceable manner to be used for image formation; a sensing part that detects a characteristic value of the parts; and a controller that determines whether the characteristic value of the parts, which fluctuates immediately after manufacture, is in a stable state based on a comparison between information regarding the characteristic value of the parts based on a detection result of the sensing part and a threshold value and sets a process condition for the image former based on the detected characteristic value when determining that the characteristic value of the parts is not in the stable state.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
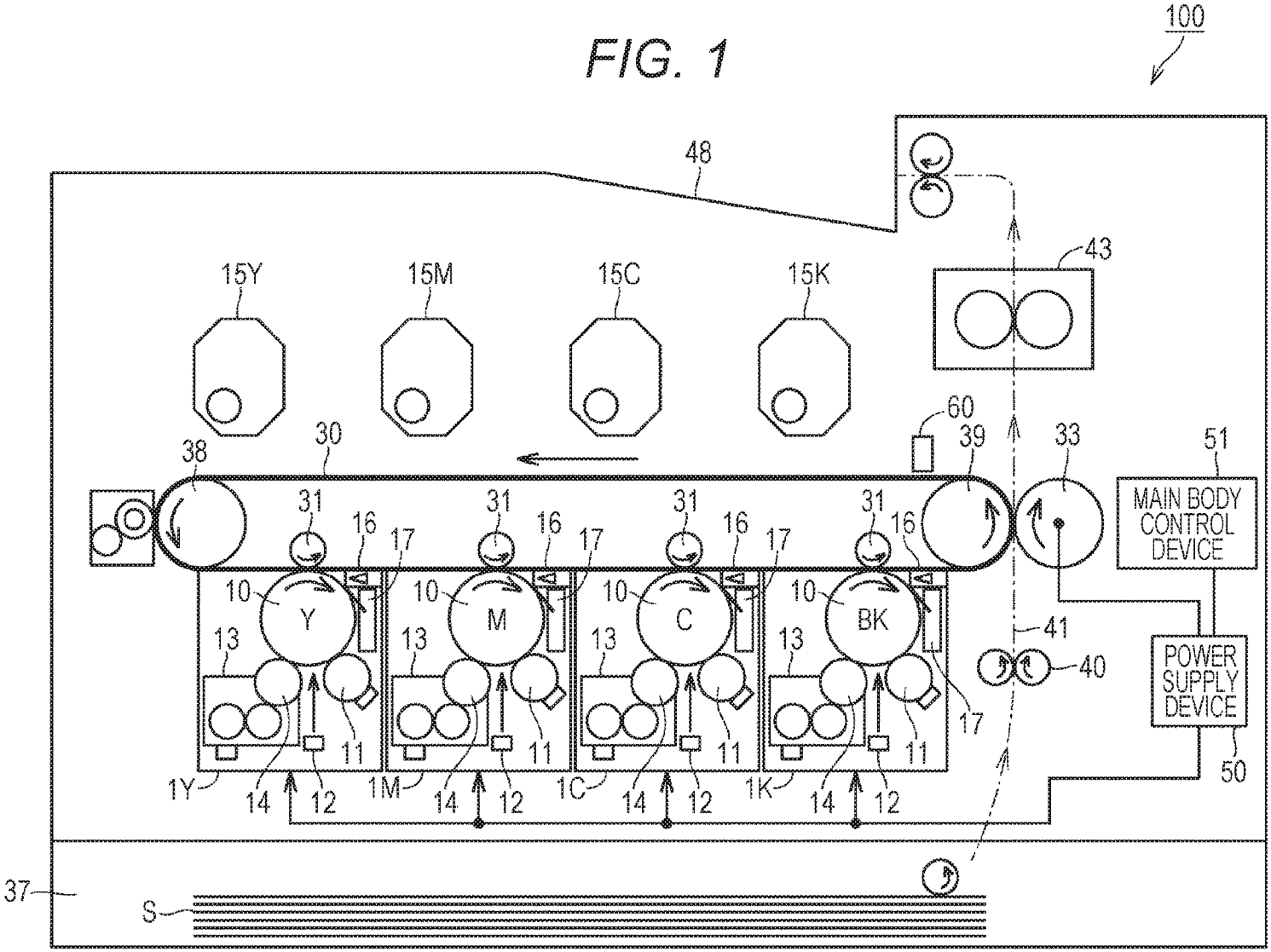
FIG. 1 is a diagram illustrating an example of the internal structure of an image forming apparatus according to a first embodiment.

Hereinafter, one or more embodiments of the present invention will be described with reference to the drawings. In the following description, the same parts and constituent elements are denoted by the same reference numerals. The names and functions thereof are also the same. Therefore, detailed description thereof will not be repeated. Note that the respective embodiments and modifications described below may be selectively combined as appropriate. However, the scope of the invention is not limited to the disclosed embodiments.

The following embodiments will describe a case where a power supply device is mounted in an image forming apparatus. Examples of the image forming apparatus include a multi-functional peripheral (MFP), a printer, a copying machine, and a facsimile.

First Embodiment

[Internal Configuration of Image Forming Apparatus]

FIG. 1 is a diagram illustrating an example of the internal structure of an image forming apparatus 100 according to a first embodiment.

FIG. 1 illustrates the image forming apparatus 100 as a color printer. The image forming apparatus 100 as a color printer will be described hereinafter, but the image forming apparatus 100 is not restricted to a color printer. For example, the image forming apparatus 100 may be a multi-functional peripheral (MFP).

The image forming apparatus 100 has a monochrome printing mode in which an image is formed using only black and a color printing mode in which an image is formed using yellow, magenta, cyan, and black.

The image forming apparatus 100 includes image forming units 1Y, 1M, 1C, and 1K, an intermediate transfer belt 30, primary transfer rollers 31, a secondary transfer roller 33, a cassette 37, a driven roller 38, a driving roller 39, a transport roller 40, a fixing device 43, and a power supply device 50.

The image forming units 1Y, 1M, 1C, and 1K are placed in order along the intermediate transfer belt 30. The image forming unit 1Y receives a supply of toner from a toner bottle 15Y to form a yellow (Y) toner image. The image forming unit 1M receives a supply of toner from a toner bottle 15M to form a magenta (M) toner image. The image forming unit 1C receives a supply of toner from a toner bottle 15C to form a cyan (C) toner image. The image forming unit 1K receives a supply of toner from a toner bottle 15K to form a black (BK) toner image.

The image forming units 1Y, 1M, 1C, and 1K are arranged along the intermediate transfer belt 30 in this order in line with a rotation direction of the intermediate transfer belt 30. Each of the image forming units 1Y, 1M, 1C, and 1K is equipped with a photoconductor 10, a charging device 11, an exposure device 12, a developing device 13, a charge eliminating device 16, and a cleaning device 17.

The charging device 11 uniformly charges a surface of the photoconductor 10. The exposure device 12 irradiates the photoconductor 10 with laser light in response to a control signal from a main body control device 51 described later and exposes the surface of the photoconductor 10 in accordance with an input image pattern. Consequently, an electrostatic latent image corresponding to the input image is formed on the photoconductor 10.

The developing device 13 applies a developing bias to a developing roller 14 while rotating the developing roller 14 such that the toner is adhered to a surface of the developing roller 14. Consequently, the toner is transferred from the developing roller 14 to the photoconductor 10 and a toner image corresponding to the electrostatic latent image is developed on the surface of the photoconductor 10.

The photoconductor 10 and the intermediate transfer belt 30 are in contact with each other at a portion where the primary transfer roller 31 is provided. The primary transfer roller 31 is configured to be rotatable. When a transfer voltage having a polarity opposite to that of the toner image is applied to the primary transfer roller 31, the toner image is transferred from the photoconductor 10 to the intermediate transfer belt 30.

In the case of the color printing mode, a toner image of yellow (Y), a toner image of magenta (M), a toner image of cyan (C), and a toner image of black (BK) are overlapped in this order and transferred from the photoconductor 10 to the intermediate transfer belt 30. Consequently, a color toner image is formed on the intermediate transfer belt 30. On the other hand, in the monochrome printing mode, a toner image of black (BK) is transferred from the photoconductor 10 to the intermediate transfer belt 30.

The intermediate transfer belt 30 is stretched around the driven roller 38 and the driving roller 39. The driving roller 39 is rotationally driven by, for example, a motor (not illustrated). The intermediate transfer belt 30 and the driven roller 38 rotate in conjunction with the driving roller 39. Consequently, the toner image on the intermediate transfer belt 30 is transported to the secondary transfer roller 33.

The charge eliminating device 16 neutralizes the charged toner adhering to the surface of the photoconductor 10. By neutralizing an electric charge of the charged toner, it becomes easy to recover the toner at the cleaning device 17 described later.

The cleaning device 17 is pressed against the photoconductor 10. The cleaning device 17 recovers the toner remaining on the surface of the photoconductor 10 after the toner image is transferred.

Sheets S are set in the cassette 37. The sheets S are sent one by one from the cassette 37 to the secondary transfer roller 33 along a transport path 41 by the transport roller 40. The secondary transfer roller 33 applies a transfer voltage having a polarity opposite to that of the toner image to the sheet S being transported. Consequently, the toner image is attracted from the intermediate transfer belt 30 to the secondary transfer roller 33 and the toner image on the intermediate transfer belt 30 is transferred to the sheet S. The transport timing of the sheet S to the secondary transfer roller 33 is adjusted by the transport roller 40 in alignment with the position of the toner image on the intermediate transfer belt 30. The toner image on the intermediate transfer belt 30 is transferred to an appropriate position on the sheet S by the transport roller 40.

The fixing device 43 pressurizes and heats the sheet S passing therethrough. Consequently, the toner image formed on the sheet S is fixed on the sheet S. Thereafter, the sheet S is discharged to a tray 48.

The power supply device 50 supplies, for example, various necessary voltages to each device in the image forming apparatus 100. As an example, the power supply device 50 supplies a transfer voltage (transfer output value) to be applied to the primary transfer roller 31.

[Hardware Configuration of Image Forming Apparatus]

Figure 2:
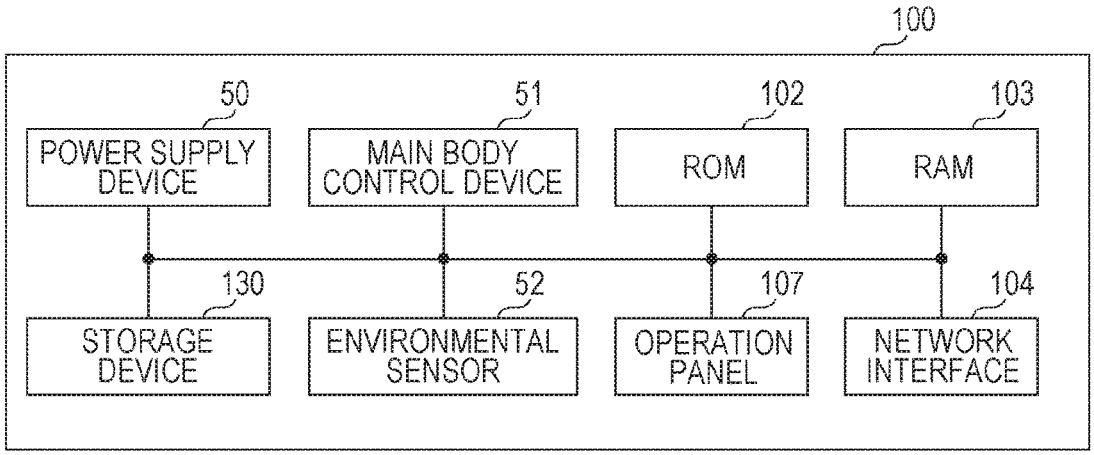
FIG. 2 is a block diagram illustrating a main hardware configuration of the image forming apparatus according to the first embodiment.

FIG. 2 is a block diagram illustrating a main hardware configuration of the image forming apparatus 100 according to the first embodiment.

An example of the hardware configuration of the image forming apparatus 100 will be described with reference to FIG. 2.

As illustrated in FIG. 2, the image forming apparatus 100 includes the power supply device 50, the main body control device 51, an environmental sensor 52, a read only memory (ROM) 102, a random access memory (RAM) 103, a network interface 104, an operation panel 107, and a storage device 130.

The main body control device 51 is constituted by, for example, at least one integrated circuit. The integrated circuit is constituted by, for example, at least one central processing unit (CPU), at least one digital signal processor (DSP), at least one application specific integrated circuit (ASIC), at least one field programmable gate array (FPGA), or a combination thereof.

The main body control device 51 controls both the power supply device 50 and the image forming apparatus 100. That is, the main body control device 51 is shared by the power supply device 50 and the image forming apparatus 100. Note that the main body control device 51 may be configured separately from the power supply device 50 or may be configured integrally with the power supply device 50. Configuring the main body control device 51 separately from the power supply device 50 simplifies the configuration of the power supply device 50.

The main body control device 51 selects either the monochrome printing mode or the color printing mode in accordance with information input to the operation panel 107 and controls the power supply device 50 and the image forming apparatus 100 in accordance with the selected mode. The main body control device 51 outputs a selected mode identification signal indicating the selected mode to the power supply device 50.

The main body control device 51 controls the action of the image forming apparatus 100 by executing a control program for the image forming apparatus 100.

The main body control device 51 reads the control program from the storage device 130 to the ROM 102 on the basis of accepting an execution command for the control program. The RAM 103 functions as a working memory and various items of data necessary for executing the control program are temporarily saved therein.

The main body control device 51 executes predetermined procedures based on the execution command for the control program. As an example, the main body control device 51 executes a process condition setting procedure, a transfer output correction procedure, and the like.

The environmental sensor 52 senses environmental information (temperature and humidity) inside the image forming apparatus 100. The environmental sensor 52 outputs the acquired environmental information to the main body control device 51.

An antenna (not illustrated) and the like are connected to the network interface 104. The image forming apparatus 100 exchanges data with an external communication appliance via the antenna. The external communication appliance includes, for example, a mobile communication terminal such as a smartphone and a server. The image forming apparatus 100 may be configured to be able to download the control program from a server via the antenna.

The operation panel 107 is constituted by a display and a touch panel. The display and the touch panel are overlapped with each other and the operation panel 107 accepts, for example, a printing operation, a scanning operation, and the like for the image forming apparatus 100.

The storage device 130 is, for example, a storage medium such as a hard disk or an external storage device. The storage device 130 saves therein the control program for the image forming apparatus 100 and the like. The saving location of the control program is not restricted to the storage device 130 and the control program may be saved in a storage area (for example, a cache) of the main body control device 51, the ROM 102, the RAM 103, an external appliance (for example, a server), or the like. Note that the control program may be provided as a part of an arbitrary program by being embedded therein instead of being provided as an independent program. In this case, a control procedure according to the present embodiment is realized in cooperation with the arbitrary program. Even such a program that does not include some of modules does not depart from the gist of the control program according to the present embodiment. Furthermore, some or all of the functions provided by the control program may be realized by dedicated hardware. Additionally, the image forming apparatus 100 may be configured in a form such as a so-called cloud service in which at least one server executes a part of the procedures of the control program.

[Intermediate Transfer Belt]

Figure 3:
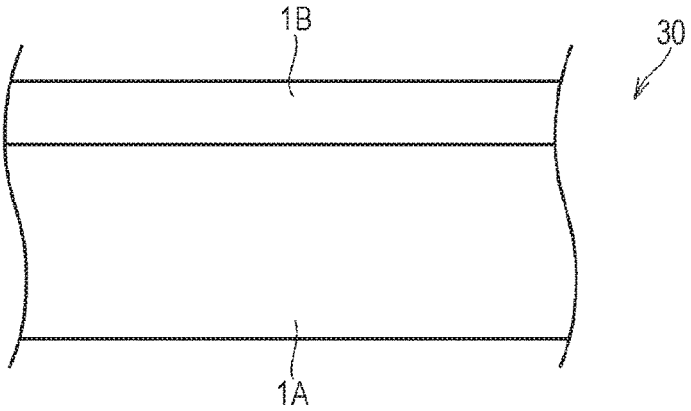
FIG. 3 is a diagram for explaining an intermediate transfer belt according to the first embodiment.

FIG. 3 is a diagram for explaining the intermediate transfer belt 30 according to the first embodiment.

Referring to FIG. 3, the intermediate transfer belt 30 includes a base material 1A and an AGP layer 1B.

The intermediate transfer belt 30 in this example has been subjected to an AGP treatment.

Specifically, a material in which carbon is dispersed in polyphenylene sulfide (PPS) as a conductive material is used as the base material 1A. An inorganic oxide thin film layer (AGP layer) is provided on the base material 1A by a plasma CVD method for the purpose of improving transferability.

As an example, a material having a film thickness of 120 μmm and a peripheral length of 700 mm, in which carbon is dispersed as a conductive material in polyphenylene sulfide (PPS), is used for the base material 1A.

Note that, in regard to the AGP treatment of the present embodiment, the inorganic oxide thin film layer preferably contains at least one oxide selected from the group consisting of $SiO_2$, $Al_2O_3$, $ZrO_2$, and $TiO_2$, in particular, $SiO_2$.

In addition, it is preferable to form the inorganic oxide thin film layer by a plasma CVD method in which a mixed gas formed of at least a discharge gas and a raw material gas of the inorganic oxide thin film layer is converted into a plasma and a film corresponding to the raw material gas is deposited and formed, in particular, by a plasma CVD method performed under the atmospheric pressure or near the atmospheric pressure.

From the viewpoint of cracking and peeling prevention, a film thickness d of the thin film layer can fall within a range of $0<d<1000$ nm, in particular, preferably a range of $100\leq d\leq 500$ nm. The base material of the intermediate transfer belt 30 is not particularly restricted, but the base material preferably has a volume resistance in a range of $10^6$ to $10^{12}$ Ω·cm and usually has a seamless belt shape.

For example, a material is used in which a conductive filler such as carbon is dispersed in a resin material such as polycarbonate (PC), polyimide (PI), polyamideimide (PAI), or polyphenylene sulfide (PPS), or the resin material contains an ionic conductive material. The thickness of the base material is usually set to about 50 to 500 μm.

Figure 4:
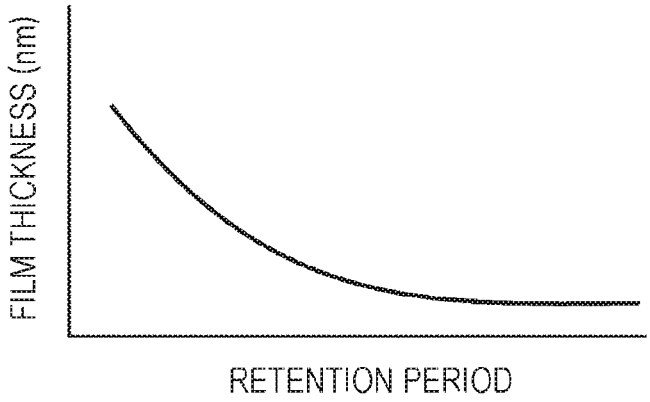
FIG. 4 is a diagram for explaining a relationship between the film thickness and a retention period of the intermediate transfer belt according to the first embodiment.

FIG. 4 is a diagram for explaining a relationship between the film thickness and a retention period of the intermediate transfer belt 30 according to the first embodiment.

As illustrated in FIG. 4, the AGP layer is condensed after film formation and the condensed state attenuates with a constant change. Then, after a predetermined retention period has elapsed, the state is shifted to a stable state.

Figure 5:
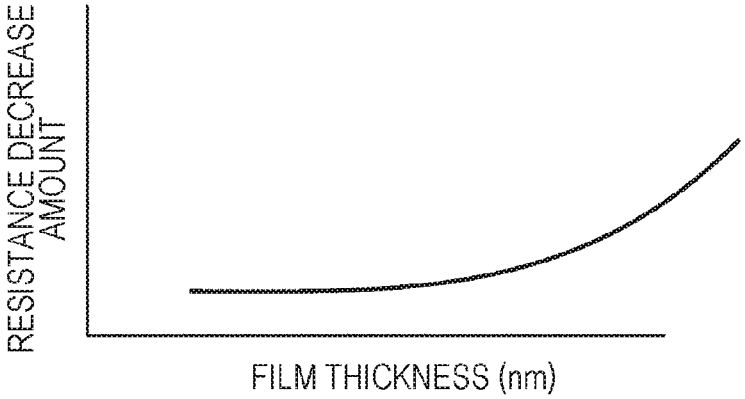
FIG. 5 is a diagram for explaining a relationship between the film thickness and a resistance decrease amount of the intermediate transfer belt according to the first embodiment.

FIG. 5 is a diagram for explaining a relationship between the film thickness and a resistance decrease amount of the intermediate transfer belt 30 according to the first embodiment.

As illustrated in FIG. 5, there is a correlation between the film thickness and the resistance decrease amount and they have a relation that the resistance decrease amount by moisture absorption becomes larger as the film thickness is made thicker.

Figure 6:
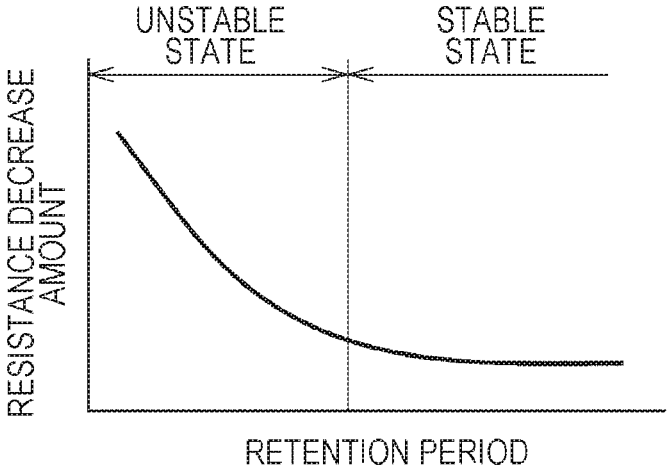
FIG. 6 is a diagram for explaining a relationship between the resistance decrease amount and the retention period of the intermediate transfer belt according to the first embodiment.

FIG. 6 is a diagram for explaining a relationship between the resistance decrease amount and the retention period of the intermediate transfer belt 30 according to the first embodiment.

Referring to FIG. 6, a diagram considering FIGS. 4 and 5 is illustrated.

Specifically, there is illustrated a case where it becomes difficult to absorb moisture as the retention period elapses and the resistance decrease amount is lowered.

That is, a resistance change due to moisture absorption is large (unstable state) for a predetermined period immediately after manufacture, in which the retention period is short, whereas the resistance change is small (stable state) after the lapse of the predetermined period since moisture absorption becomes difficult.

In the embodiment, it is determined whether the characteristic of parts is in a stable state and an appropriate process condition is set according to each state.

Figure 7:
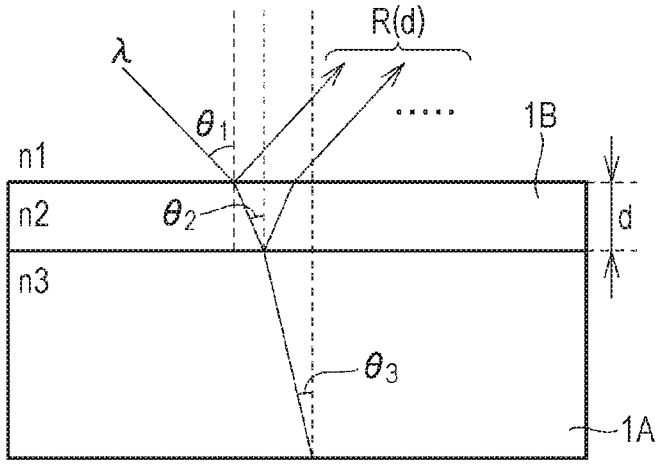
FIG. 7 is a diagram for explaining a technique of detecting the film thickness of the intermediate transfer belt according to the first embodiment.

FIG. 7 is a diagram for explaining a technique of detecting the film thickness of the intermediate transfer belt 30 according to the first embodiment.

Referring to FIG. 7, in this example, the film thickness is detected by an optical sensor 60 having a light projector and a light receiver.

When the inorganic oxide thin film layer (AGP layer) is provided on an outermost layer of the intermediate transfer belt 30, optical interference occurs due to a difference in refractive index.

As an example, there is illustrated a case schematically expressing the optical interference when the intermediate transfer belt 30 is irradiated with light (main wavelength λ) from the light projector of the optical sensor 60.

Interference occurs in reflected light at an interface between an air layer (refractive index n1) and the thin film layer (refractive index n2) and at an interface between the thin film layer (refractive index n2) and the base material (refractive index n3).

Figure 8:
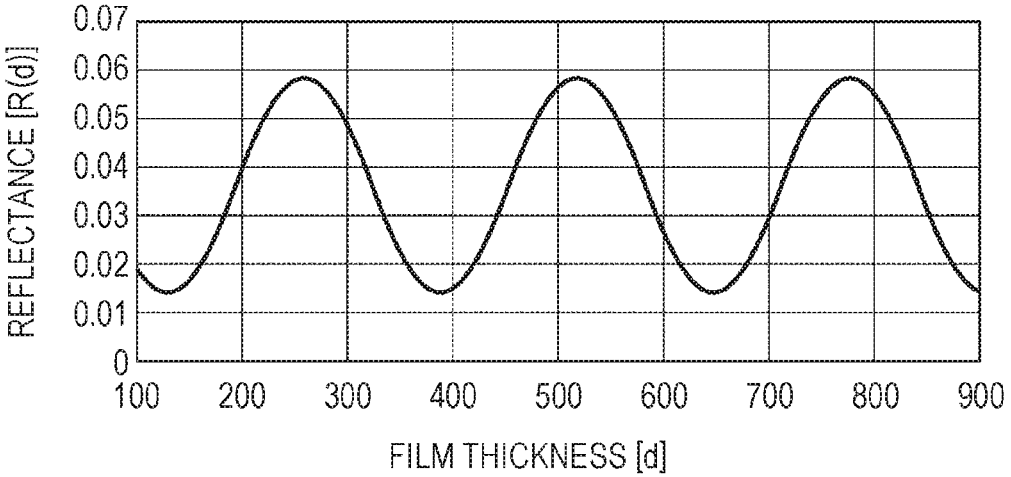
FIG. 8 is a diagram for explaining a reflectance corresponding to the film thickness of the intermediate transfer belt according to the first embodiment.

FIG. 8 is a diagram for explaining a reflectance corresponding to the film thickness of the intermediate transfer belt 30 according to the first embodiment.

Referring to FIG. 8, the reflectance is illustrated as a periodic waveform in accordance with the interference in reflected light received by the light receiver of the optical sensor 60.

Specifically, a relationship between the reflectance of a surface of the intermediate transfer belt 30 while the toner is not carried on the surface with respect to the emission main wavelength λ of the light projector of the optical sensor 60 and the film thickness d (nm) of the thin film layer on the surface of the intermediate transfer belt 30 is expressed by a reflectance function R(d).

As an example, a relationship between the film thickness and the reflectance at an emission main wavelength of 730 nm and an incident angle of 20° will be described.

The reflectance function R(d) can be easily calculated by a matrix computation using a matrix method expressed by the following mathematical formula.

[Mathematical Formula 1]

$$R(d) = 0.5 \times \left( \frac{A^2 + B^2 + 2AB\cos 2\delta}{1 + A^2 + B^2 + 2AB\cos 2\delta} + \frac{C^2 + D^2 + 2CD\cos 2\delta}{1 + C^2 + D^2 + 2CD\cos 2\delta} \right)$$

$$A = \frac{n2\cos\theta 1 - n1\cos\theta 2}{n2\cos\theta 1 + n1\cos\theta 2}$$

$$B = \frac{n3\cos\theta 2 - n2\cos\theta 3}{n3\cos\theta 2 + n2\cos\theta 3}$$

$$C = \frac{n1\cos\theta 1 - n2\cos\theta 2}{n1\cos\theta 1 + n2\cos\theta 2}$$

$$D = \frac{n2\cos\theta 2 - n3\cos\theta 3}{n2\cos\theta 2 + n3\cos\theta 3}$$

$$\delta = \frac{2\pi n2 d\cos\theta 2}{\lambda}$$

It is possible to measure the film thickness d in accordance with this reflectance function R(d).

[Process Condition Setting]

In the present embodiment, the film thickness of the AGP layer is detected using the optical sensor 60 provided in the image forming apparatus 100. The detection result of the optical sensor 60 is output to the main body control device 51. The main body control device 51 compares this detected film thickness with a threshold value as information regarding a characteristic value of the intermediate transfer belt 30. It is determined whether the characteristic value of the intermediate transfer belt 30 is in a stable state based on the comparison result and the frequency of sensing the resistance of the intermediate transfer belt 30 (a correction frequency of the transfer output) is controlled based on the determination result.

In general, the AGP layer on the surface layer of the intermediate transfer belt 30 is often formed to be thicker than a target film thickness by presuming film condensation after manufacture in advance.

In the intermediate transfer belt of the embodiment, when the film thickness of the surface layer having an initial film thickness of 440 nm becomes 400 nm or less, the resistance decrease amount due to moisture absorption is lowered.

In the embodiment, the film thickness of the surface layer of the intermediate transfer belt 30 is detected based on the reflectance function R(d) during an image printing action.

Based on a comparison between the detected film thickness and a threshold value (400 nm), it is determined whether the characteristic value of the intermediate transfer belt 30 is in a stable state.

In this example, when the detected film thickness of the surface layer is 400 nm or more, an unstable state is determined and the frequency of adjusting the transfer output of the intermediate transfer belt 30 is set higher as the process condition.

As the adjustment of the transfer output, as described above, the resistance change in the intermediate transfer belt 30 is detected and the optimum transfer output is set based on this resistance change in the intermediate transfer belt 30. Specifically, the resistance change in the intermediate transfer belt 30 is read based on a voltage given when a constant current is passed from the primary transfer roller 31 to the photoconductor 10. Then, based on this resistance change, the transfer output is set to a proper transfer output value for the primary transfer roller 31.

When the film condensation progression of the AGP layer of the intermediate transfer belt 30 is more moderate (unstable state), the resistance decrease amount of the intermediate transfer belt 30 due to moisture absorption while left to stand is larger. When the inside temperature of the image forming apparatus 100 increases due to image formation, the moisture content of the intermediate transfer belt 30 decreases and a resistance value rises. Therefore, since a resistance change amount (increase amount) becomes larger, it is possible to suppress a deviation from the optimum output by setting the correction frequency of the transfer output higher.

If the correction frequency of the transfer output of the intermediate transfer belt 30 is always set high, a deviation from the optimum output can be suppressed but the print productivity decreases.

In a case where the film condensation progression of the AGP layer of the intermediate transfer belt 30 is sufficiently advanced (stable state), since the moisture absorption is difficult even while left to stand, the resistance decrease amount of the intermediate transfer belt 30 is small. Therefore, it is not necessary to set the correction frequency of the transfer output higher.

For that reason, when the film condensation progression of the intermediate transfer belt 30 has been sufficiently advanced (stable state), the deterioration state of the intermediate transfer belt 30 is determined depending not on a sensing result for the film thickness of the AGP layer by the optical sensor 60 but on a traveling distance and the number of printed sheets such that the correction frequency of the transfer output is set based on this determination result. For example, the correction procedure for the transfer output may be executed for every thousands of printed sheets.

Figure 9:
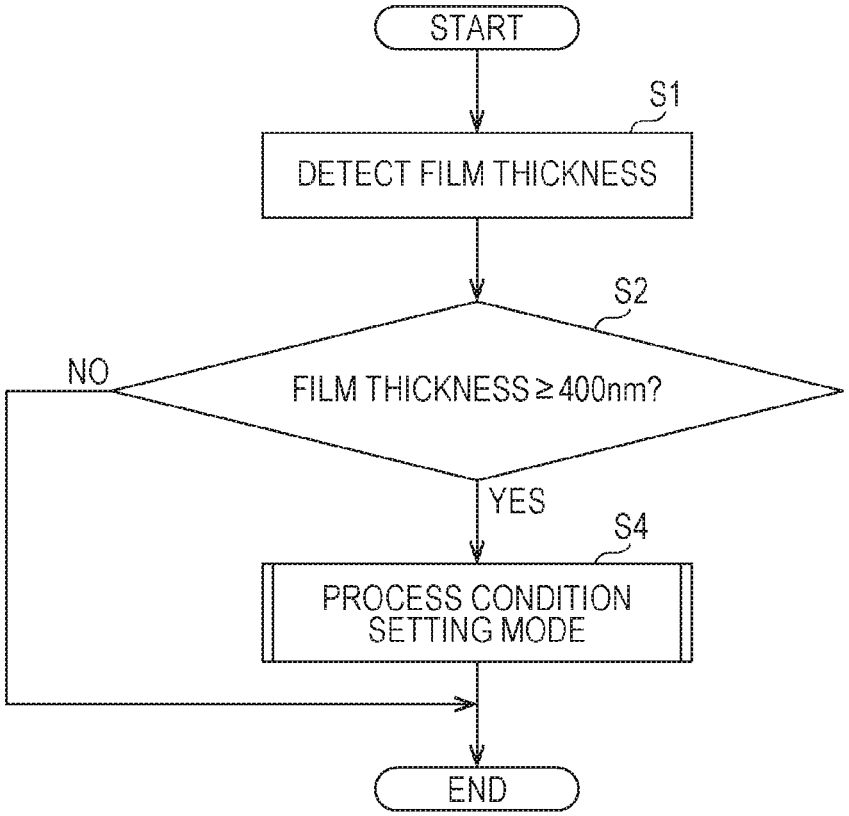
FIG. 9 is a flowchart for explaining a process condition setting procedure according to the first embodiment.

FIG. 9 is a flowchart for explaining a process condition setting procedure according to the first embodiment.

Referring to FIG. 9, the image forming apparatus 100 detects the film thickness (step S1). Specifically, the optical sensor 60 causes the light receiver to receive reflected light obtained by irradiating the intermediate transfer belt 30 with light having the wavelength λ from the light projector. The main body control device 51 calculates the film thickness d based on the reflectance function R(d). As an example, it is possible to execute a procedure of detecting the film thickness when the image forming apparatus 100 is activated. Alternatively, the film thickness may be detected when the standing for a long period of time is sensed.

Next, the image forming apparatus 100 determines whether or not the film thickness d is 400 nm or more (step S2). The main body control device 51 determines whether or not the calculated film thickness d is 400 nm or more.

When determining that the film thickness d is 400 nm or more (YES in step S2), the image forming apparatus 100 determines that the intermediate transfer belt 30 is in an unstable state in which the resistance decrease therein is large and shifts to a process condition setting mode in which the process condition is set based on the detection result for the film thickness of the AGP layer (step S4). In this example, the correction frequency of the transfer output is set as the process condition setting mode.

Thereafter, the procedure is terminated (end).

On the other hand, when determining that the film thickness d is less than 400 nm (NO in step S2), the image forming apparatus 100 skips step S4 and terminates the procedure. In this case, it is determined that the intermediate transfer belt 30 is in a stable state in which the resistance decrease therein is small and the deterioration state of the intermediate transfer belt 30 is determined depending not on the detection result for the film thickness of the AGP layer but on the traveling distance and the number of printed sheets such that the correction frequency of the transfer output is set based on the deterioration state.

Figure 10:
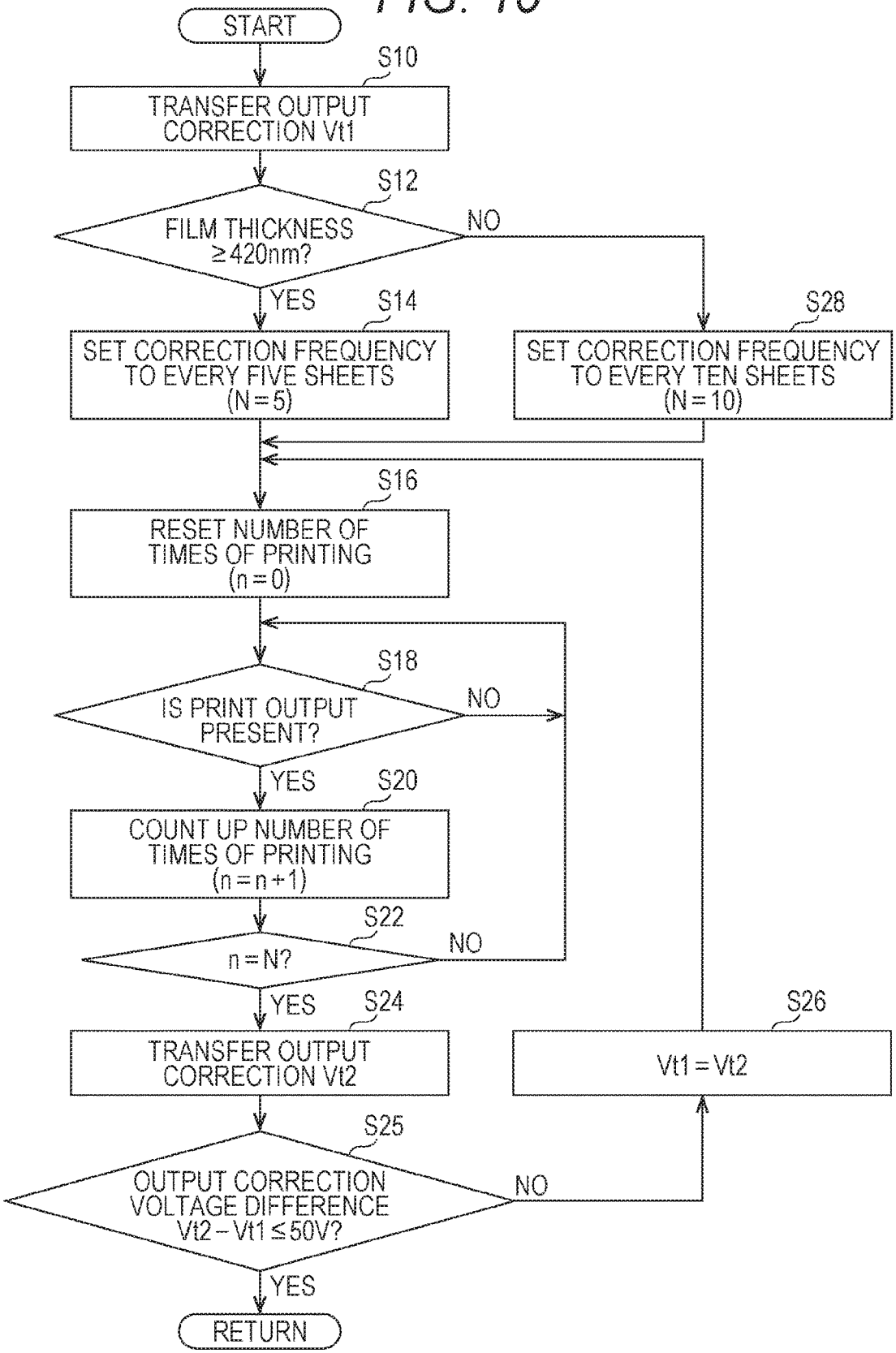
FIG. 10 is a subroutine diagram for explaining a process condition setting mode according to the first embodiment.

FIG. 10 is a subroutine diagram for explaining a process condition setting mode according to the first embodiment. The procedure is performed mainly in the main body control device 51.

Referring to FIG. 10, the image forming apparatus 100 executes correction of the transfer output (step S10). Specifically, the main body control device 51 reads the resistance change in the intermediate transfer belt 30 based on a voltage given when a constant current is passed from the primary transfer roller 31 to the photoconductor 10. Then, the transfer output is set to a proper transfer output value Vt1 based on the resistance change.

Next, the image forming apparatus 100 determines whether or not the detected film thickness d is 420 nm or more (step S12). The main body control device 51 determines whether or not the detected film thickness d is 420 nm or more.

In step S12, when determining that the detected film thickness d is 420 nm or more (YES in step S12), the image forming apparatus 100 sets the correction frequency to every five sheets (step S14). When determining that the detected film thickness d is 420 nm or more, the main body control device 51 sets the correction frequency (N) of the transfer output to every five sheets.

On the other hand, in step S12, when determining that the detected film thickness d is not 420 nm or more (NO in step S12), the image forming apparatus 100 sets the correction frequency to every ten sheets (step S28). When determining that the detected film thickness d is not 420 nm or more, the main body control device 51 sets the correction frequency (N) of the transfer output to every ten sheets.

Next, the image forming apparatus 100 resets (0) the number of times of printing n (step S16). The main body control device 51 initializes the number of times of printing n.

Next, the image forming apparatus 100 determines whether print output is present (step S18). The main body control device 51 determines whether an instruction for print output is present.

In step S18, when no print output is present (NO in step S18), the image forming apparatus 100 maintains the state of step S18 and, when print output is present (YES in step S18), then counts up the number of times of printing (n=n+1) (step S20). The main body control device 51 counts up the number of times of printing in accordance with an instruction for print output.

Next, the image forming apparatus 100 determines whether the number of times of printing has reached the set correction frequency (step S22). The main body control device 51 determines whether the number of times of printing has reached the correction frequency (N).

In step S22, when determining that the number of times of printing has reached the set correction frequency (YES in step S22), the image forming apparatus 100 executes transfer output correction (step S24). Specifically, the main body control device 51 reads the resistance change in the intermediate transfer belt 30 based on a voltage given when a constant current is passed from the primary transfer roller 31 to the photoconductor 10. Then, the transfer output is set to a proper transfer output value Vt2 based on the resistance change.

Next, the image forming apparatus 100 determines whether the change amount of the transfer output value is within a predetermined value (step S25). Specifically, the main body control device 51 calculates the change amount of the transfer output value (Vt2−Vt1) and determines whether the calculated change amount is within 50 V.

In step S25, when determining that the change amount of the transfer output value (Vt2−Vt1) is within the predetermined value (50 V) (YES in step S25), the image forming apparatus 100 terminates the procedure (return). When determining that the change amount of the transfer output value (Vt2−Vt1) is within 50 V, the main body control device 51 terminates the procedure.

On the other hand, in step S25, when determining that the change amount of the transfer output value (Vt2−Vt1) is not within the predetermined value (50 V) (NO in step S25), the image forming apparatus 100 proceeds to step S26.

In step S26, the image forming apparatus 100 updates the transfer output value Vt1 to the transfer output value Vt2. When determining that the change amount of the transfer output value (Vt2−Vt1) is not within 50 V, the main body control device 51 terminates the procedure.

Then, the procedure returns to step S16. Thereafter, the above procedure is repeated.

That is, the procedure in the process condition setting mode is terminated when the change amount of the transfer output value (Vt2−Vt1) falls below the predetermined value (50 V).

When the procedure in the process condition setting mode is terminated, the image forming apparatus 100 determines that the intermediate transfer belt 30 is in a stable state in which the resistance decrease therein is small as described above and determines the deterioration state of the intermediate transfer belt 30 depending not on the detection result for the film thickness of the AGP layer but on the traveling distance and the number of printed sheets so as to set the correction frequency of the transfer output based on the deterioration state.

The above description has explained the technique of setting the process condition based on the film thickness (characteristic value) of the intermediate transfer belt 30 according to the determination on whether or not the film thickness is 400 nm or more as a threshold value, but the present invention is not limited to this example. Since the film thickness (characteristic value) at which the characteristics are stable differs depending on replaceable parts as an object, it is possible to arbitrarily set the threshold value.

In this example, the characteristic change of the intermediate transfer belt 30 after manufacture has been described as an example, but the present invention is not limited to the intermediate transfer belt in particular. It is possible to set the process condition using the same technique as above because there is a possibility that the characteristic change occurs during a certain period after manufacture even in other replacement parts formed with a thin layer on the surface layer (for example, a photoconductor, a charging roller, a transfer roller, a developing roller, a fixing roller, and a UV curing coated belt).

Second Embodiment

The film thickness of the surface layer of the intermediate transfer belt 30 does not always converge to the same film thickness, but a slight deviation occurs in the target film thickness after the film condensation due to manufacturing variations or depending on the retention environment or use environment.

In a second embodiment, a film thickness change rate α is calculated based on a film thickness (L1) of an intermediate transfer belt 30 detected at an arbitrary timing (T1) and a film thickness (L2) thereof detected at the time of image forming action (T2).

$$\alpha=|(L2-L1)|/(T2-T1)$$

The film thickness change rate of the intermediate transfer belt 30 is compared with a threshold value as information regarding a specific value. Based on the comparison result, it is determined whether the characteristic value of the intermediate transfer belt 30 is in a stable state.

In this example, an unstable state is determined when the film thickness change rate is one or more and the frequency of sensing the resistance of the intermediate transfer belt 30 (correction frequency of transfer output) is set high as the process condition.

The resistance change in the intermediate transfer belt 30 is detected and the optimum transfer output is set based on this resistance change in the intermediate transfer belt 30. Specifically, the resistance change in the intermediate transfer belt 30 is read based on a voltage given when a constant current is passed from a primary transfer roller 31 to a photoconductor 10. Then, the transfer output is set to a proper transfer output value for the primary transfer roller 31 based on the resistance change.

When the film condensation progression of an AGP layer of the intermediate transfer belt 30 is more moderate (unstable state), the resistance decrease amount of the intermediate transfer belt 30 due to moisture absorption while left to stand is larger. When the inside temperature of an image forming apparatus 100 increases due to image formation, the moisture content of the intermediate transfer belt 30 decreases and a resistance value rises. Therefore, since a resistance change amount (increase amount) becomes larger, it is possible to suppress a deviation from the optimum output by making the correction frequency of the transfer output higher.

As an example, the film thickness change amount and the resistance decrease amount of the intermediate transfer belt 30 immediately after manufacture were ascertained in the intermediate transfer belt 30 as follows.

Immediately after manufacture to 7 days: Film thickness change amount was 440 nm to 419 nm (film thickness change rate α=3 (nm/day)), the resistance decrease amount was large 7 to 15 days: Film thickness change amount was 419 nm to 403 nm (film thickness change rate α=2 (nm/day)), the resistance decrease amount was middle 15 to 20 days: Film thickness change amount was 403 nm to 398 nm (film thickness change rate α=1 (nm/day)), the resistance decrease amount was small When the film thickness change rate α becomes one or less, the resistance decrease amount due to moisture absorption is lowered.

In the embodiment, based on a comparison between the film thickness change rate α and a threshold value (1), it is determined whether the characteristic value of the intermediate transfer belt 30 is in a stable state.

In this example, an unstable state is determined when the film thickness change rate α is larger than one and the frequency of sensing the resistance of the intermediate transfer belt 30 (correction frequency of transfer output) is set high as the process condition.

The resistance change in the intermediate transfer belt 30 is detected and the optimum transfer output is set based on this resistance change in the intermediate transfer belt 30. Specifically, the resistance change in the intermediate transfer belt 30 is read based on a voltage given when a constant current is passed from a primary transfer roller 31 to a photoconductor 10. Then, the transfer output is set to a proper transfer output value for the primary transfer roller 31 based on the resistance change.

When the film thickness change rate α of the intermediate transfer belt 30 is large (unstable state), the resistance decrease amount of the intermediate transfer belt due to moisture absorption while left to stand is large. When the inside temperature of an image forming apparatus 100 increases due to image formation, the moisture content of the intermediate transfer belt 30 decreases and a resistance value rises. Therefore, since the resistance change amount (increase amount) becomes larger, it is possible to suppress a deviation from the optimum output by making the correction frequency of the transfer output higher.

If the frequency of correcting the transfer output of the intermediate transfer belt 30 is always set high, a deviation from the optimum output can be suppressed but the print productivity decreases.

When the film thickness change rate α of the intermediate transfer belt 30 is equal to or less than the threshold value 1 (stable state), the resistance decrease amount of the intermediate transfer belt 30 due to moisture absorption while left to stand is small. Therefore, it is not necessary to set the correction frequency of the transfer output higher.

For that reason, when the film thickness change rate α of the intermediate transfer belt 30 is small (stable state), the deterioration state of the intermediate transfer belt 30 is determined depending not on a sensing result for the film thickness of the AGP layer by an optical sensor 60 but on the traveling distance and the number of printed sheets such that the correction frequency of the transfer output is set based on this determination result.

Figure 11:
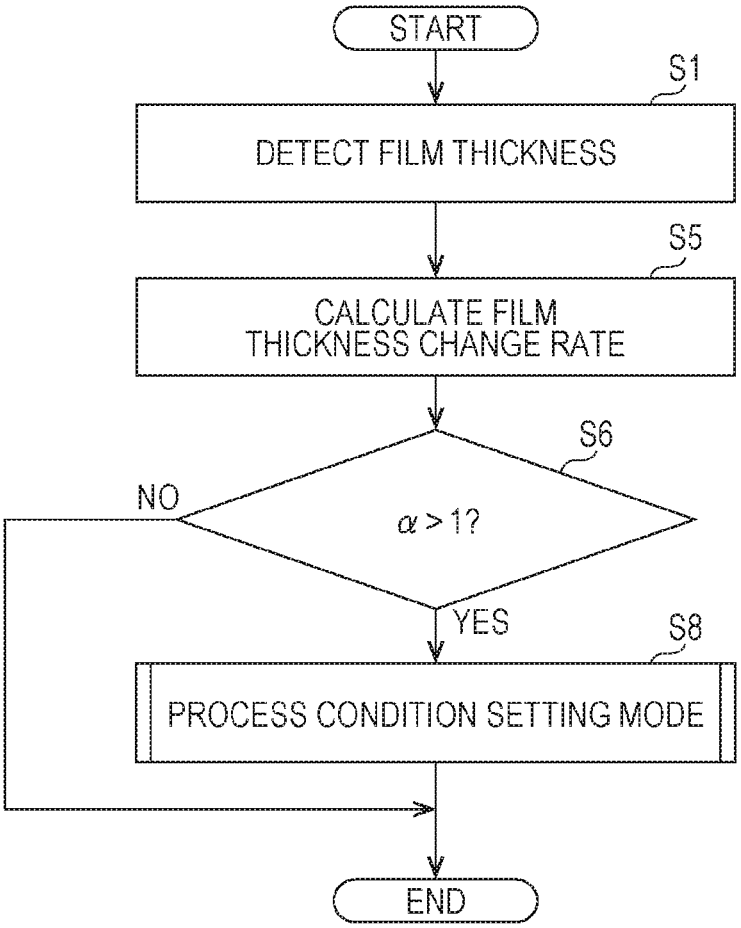
FIG. 11 is a flowchart for explaining a process condition setting procedure according to a second embodiment.

FIG. 11 is a flowchart for explaining a process condition setting procedure according to the second embodiment.

Referring to FIG. 11, the image forming apparatus 100 detects the film thickness (step S1). Specifically, the optical sensor 60 causes a light receiver to receive reflected light obtained by irradiating the intermediate transfer belt 30 with light having the wavelength λ from a light projector. A main body control device 51 calculates the film thickness d based on the reflectance function R(d). As an example, it is possible to execute a procedure of detecting the film thickness when the image forming apparatus 100 is activated. Alternatively, the film thickness may be detected when the standing for a long period of time is sensed.

Next, the image forming apparatus 100 calculates the film thickness change rate α (step S5).

Specifically, in the second embodiment, the main body control device 51 calculates the film thickness change rate α based on the film thickness (L1) of the intermediate transfer belt 30 detected at the arbitrary timing (T1) and the film thickness (L2) thereof detected at the time of image forming action (T2).

Next, the image forming apparatus determines whether the film thickness change rate α is larger than the threshold value 1 (step S6). The main body control device 51 determines whether the calculated film thickness change rate α is larger than the threshold value 1.

Next, when determining that the film thickness change rate α is larger than the threshold value 1 (YES in step S6), the image forming apparatus 100 determines that the intermediate transfer belt 30 is in an unstable state in which the resistance decrease therein is large and shifts to a process condition setting mode in which the process condition is set based on the film thickness change rate α (step S8). In this example, the correction frequency of the transfer output is set as the process condition setting mode.

Thereafter, the procedure is terminated (end).

On the other hand, when determining that the film thickness change rate α is equal to or less than the threshold value 1 (NO in step S6), the image forming apparatus 100 skips step S8 and terminates the procedure. In this case, it is determined that the intermediate transfer belt 30 is in a stable state in which the resistance decrease therein is small and the deterioration state of the intermediate transfer belt 30 is determined depending not on the film thickness change rate α but on the traveling distance and the number of printed sheets such that the correction frequency of the transfer output is set based on the deterioration state.

Figure 12:
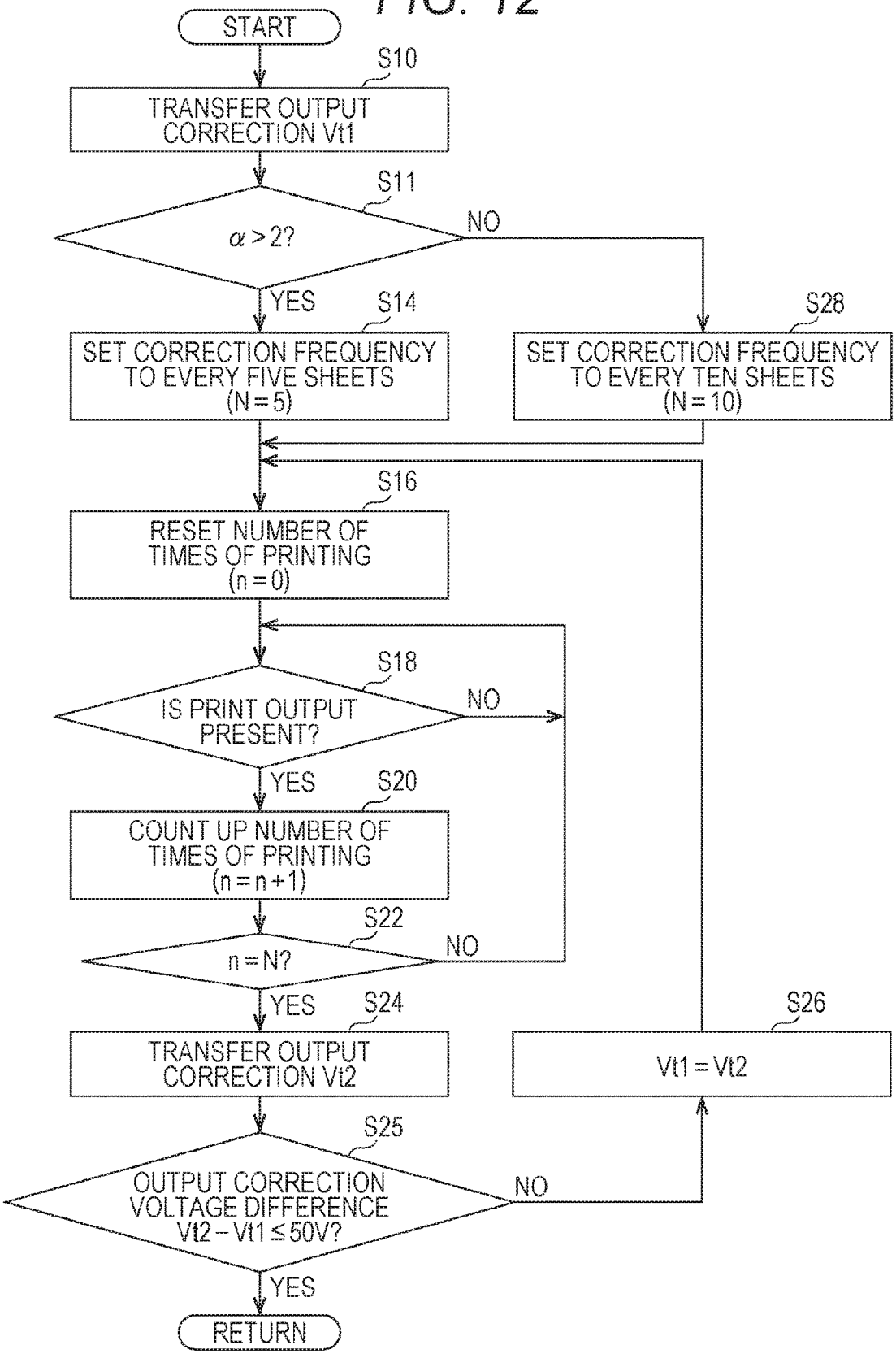
FIG. 12 is a subroutine diagram for explaining a process condition setting mode according to the second embodiment.

FIG. 12 is a subroutine diagram for explaining a process condition setting mode according to the second embodiment.

Referring to FIG. 12, the image forming apparatus 100 executes transfer output correction (step S10). Specifically, the main body control device 51 reads the resistance change in the intermediate transfer belt 30 based on a voltage given when a constant current is passed from the primary transfer roller 31 to the photoconductor 10. Then, the transfer output is set to a proper transfer output value Vt1 based on the resistance change.

Next, the image forming apparatus 100 determines whether the film thickness change rate α is larger than two (step S11). The main body control device 51 determines whether the calculated film thickness change rate α is larger than two.

In step S11, when determining that the film thickness change rate α is larger than two (YES in step S11), the image forming apparatus 100 sets the correction frequency to every five sheets (step S14). When determining that the calculated film thickness change rate α is larger than two, the main body control device 51 sets the correction frequency (N) of the transfer output to every five sheets.

On the other hand, in step S11, when determining that the film thickness change rate α is two or less (NO in step S11), the image forming apparatus 100 sets the correction frequency to every ten sheets (step S28). When determining that the calculated film thickness change rate α is two or less, the main body control device 51 sets the correction frequency (N) of the transfer output to every ten sheets.

Next, the image forming apparatus 100 resets (0) the number of times of printing n (step S16). The main body control device 51 initializes the number of times of printing n. Since the subsequent procedure is the same as the flow explained with reference to FIG. 10, the detailed description thereof will not be repeated.

Specifically, the main body control device 51 sets the transfer output value every predetermined number of sheets and the procedure in the process condition setting mode is terminated when the change amount of the transfer output value (Vt2−Vt1) falls below the predetermined value (50 V).

When the procedure in the process condition setting mode is terminated, the image forming apparatus 100 determines that the intermediate transfer belt 30 is in a stable state in which the resistance decrease therein is small as described above and determines the deterioration state of the intermediate transfer belt 30 depending not on the detection result for the film thickness of the AGP layer but on the traveling distance and the number of printed sheets so as to set the correction frequency of the transfer output based on the deterioration state.

The above description has explained the technique of setting the process condition based on the film thickness change rate (characteristic value) of the intermediate transfer belt 30 according to the determination on whether the film thickness change rate is larger than one as a threshold value, but the present invention is not limited to this example. Since the film thickness (characteristic value) at which the characteristics are stable differs depending on replaceable parts as an object, it is possible to arbitrarily set the threshold value.

Third Embodiment

The above first and second embodiments have described the technique of executing the process condition setting mode in an unstable state in which the resistance change in the intermediate transfer belt 30 is large.

Meanwhile, the resistance change in the intermediate transfer belt 30 may become particularly noticeable under high temperature and high humidity.

Therefore, it is also possible to employ a technique of determining whether it is under high temperature and high humidity, and executing the process condition setting mode when it is determined that it is at a high temperature and high humidity.

Figure 13:
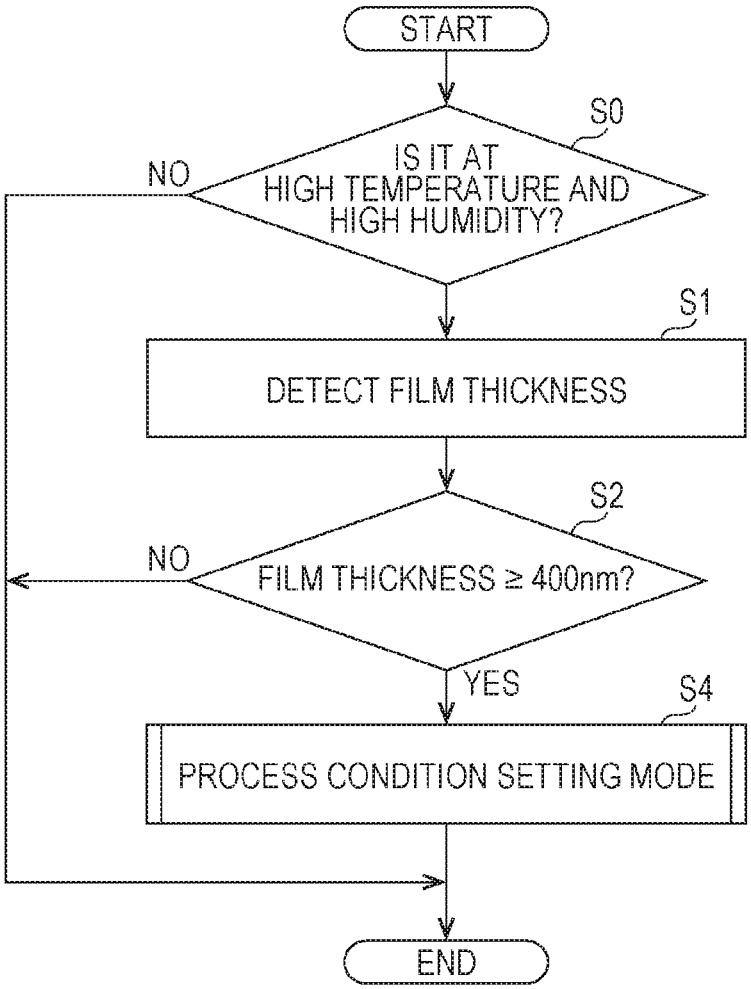
FIG. 13 is a flowchart for explaining a process condition setting procedure according to a third embodiment.

FIG. 13 is a flowchart for explaining a process condition setting procedure according to a third embodiment.

Referring to FIG. 13, an image forming apparatus 100 determines whether it is at a high temperature and high humidity (step S0). Specifically, based on the detection result from an environmental sensor 52, a main body control device 51 determines whether the environmental situation of the image forming apparatus 100 has a high temperature and high humidity (step S0). The temperature and humidity in the environment under high temperature and high humidity may be specified as, for example, a temperature of 30° C. or higher and a humidity of 85% or higher.

In step S0, when determining that the environmental situation has a high temperature and high humidity (YES in step S0), the image forming apparatus 100 proceeds to step S1 and detects the film thickness. Since the subsequent procedure is the same as explained with reference to FIG. 9, the detailed description thereof will not be repeated.

In step S0, when it is determined that the environmental situation of the image forming apparatus 100 does not have a high temperature and high humidity (NO in step S0), the procedure is terminated (end).

According to this technique, it is also possible to employ a technique of determining whether it is under high temperature and high humidity, and executing the process condition setting mode when it is determined that it is at a high temperature and high humidity.

Note that it is a matter of course that this technique can also be applied to the second embodiment.

Fourth Embodiment

A fourth embodiment will describe a transport roller 40 (timing roller) having a surface layer made up with a thin film layer similar to that described in the above embodiments.

The transport roller 40 is a metal roller and regulates the timing of sheet entry before a secondary transfer.

Since the transport roller 40 comes into contact with the sheet, paper dust and contamination tend to stick thereto. By forming the thin film layer described in the above first embodiment, however, the releasability of the surface layer is improved and it becomes difficult for contamination to stick thereto.

Meanwhile, a predetermined retention period is necessary from the time when the surface layer is created until it is stabilized.

In this respect, the characteristic value fluctuates depending on the degree of moisture absorption on the surface layer of the transport roller 40.

Specifically, immediately after the manufacture of the transport roller 40, the surface tends to contain moisture such that the coefficient of friction thereof becomes high. If a sufficient period has elapsed after manufacture, it becomes difficult to absorb moisture such that the coefficient of friction becomes low.

Therefore, when a constant driving force is imparted to the transport roller 40, the coefficient of friction varies between immediately after manufacture and when a sufficient period has elapsed after manufacture and thus there is a possibility of a transport defect arising in the sheet.

As a technique of sensing the film thickness of the surface layer of the transport roller 40, the film thickness can be sensed using the same technique as described in the first embodiment by providing an optical sensor facing the transport roller 40.

In the present fourth embodiment, the film thickness of the transport roller 40 is detected using an optical sensor. This detected film thickness is compared with a threshold value as information regarding the characteristic value of the transport roller 40. It is determined whether the characteristic value of the transport roller 40 is in a stable state based on the comparison result and a drive start timing of the transport roller 40 is controlled as the process condition based on the determination result.

Specifically, when the film thickness of the transport roller 40 is compared with the threshold value and the film thickness of the transport roller 40 is equal to or larger than the threshold value (400 nm), it is determined that the characteristic value of the transport roller 40 is not in a stable state. In this case, that is, while the coefficient of friction of the transport roller 40 is high immediately after manufacture, no slip occurs between the sheet and the transport roller 40 and thus the drive start timing is set to be later.

On the other hand, when the film thickness of the transport roller 40 is compared with the threshold value and the film thickness of the transport roller 40 is less than the threshold value (400 nm), it is determined that the coefficient of friction is in a low state that follows the elapse of a sufficient period after the manufacture of the transport roller 40. In this case, that is, while the coefficient of friction of the transport roller 40 is low when a sufficient period has elapsed after the manufacture of the transport roller 40, a slip occurs between the sheet and the transport roller 40 and thus the drive start timing is set to be earlier.

By executing the drive control of the transport roller 40, it is possible to correct a deviation of the timing of sheet entry to a secondary transfer roller 33, whereby image displacement can be suppressed.

Note that the characteristic value detected to determine whether the replacement parts are stable is not limited to the film thickness as in the above embodiments. For example, for an image carrier (photoconductor), a surface potential may be detected as the characteristic value for determining whether the image carrier is stable after manufacture. When it is determined that the image carrier is not stable, a bias or exposure output to be applied to the image carrier or the light amount of charge eliminating light may be modified, or alternatively, the timing of settling these process conditions may be modified.

Note that the present examples have described the case of mainly using the technique for the image forming apparatus. However, the present invention is not limited to the image forming apparatus in particular and this technique can be used for other purposes in general.

Although embodiments of the present invention have been described and illustrated in detail, the disclosed embodiments are made for purposes of illustration and example only and not limitation. The scope of the present invention should be interpreted by terms of the appended claims and it is intended that all modifications within the meaning and scope of the claims and the equivalents thereof are included.

What is claimed is:

1. An image forming apparatus comprising:

an image former having a part provided in a replaceable manner to be used for image formation;

a sensing part that detects a characteristic value of the part; and a controller that determines whether the characteristic value of the part, which is not in a stable state within a retention period immediately after manufacture because the characteristic value fluctuates within the retention period immediately after manufacture, is in a stable state based on a comparison between information regarding the characteristic value of the part based on a detection result of the sensing part and a threshold value and sets a process condition for the image former based on the detected characteristic value when determining that the characteristic value of the part is not in the stable state.

2. The image forming apparatus according to claim 1, wherein the controller determines whether a change rate of the characteristic value of the part is equal to or less than a threshold value in such a manner to determine that the characteristic value of the part is not in the stable state when determining that the change rate is not equal to or less than the threshold value and determine that the characteristic value of the part is in the stable state when determining that the change rate is equal to or less than the threshold value.

3. The image forming apparatus according to claim 1, wherein, when determining that the characteristic value of the part is in the stable state, the controller sets the process condition for the image former based on information different from the information regarding the detected characteristic value of the part.

4. The image forming apparatus according to claim 1, wherein the controller sets at least one of control of transfer voltage to the part, resistance detection control for the part, and drive control for the part as the process condition for the image former.

5. The image forming apparatus according to claim 1, wherein the part is an intermediate transfer body including a base layer and a surface layer.

6. The image forming apparatus according to claim 5, wherein, when determining that the characteristic value of the part is not in the stable state, the controller sets a frequency of sensing resistance of the intermediate transfer body based on the detected characteristic value.

7. The image forming apparatus according to claim 6, wherein, when determining that the characteristic value of the part is not in the stable state, the controller sets a transfer voltage of the intermediate transfer body according to a resistance value of the intermediate transfer body.

8. The image forming apparatus according to claim 5, wherein the sensing part detects a surface layer film thickness of the intermediate transfer body, and the controller determines whether the characteristic value of the intermediate transfer body, which fluctuates immediately after manufacture, is in a stable state based on a comparison between the detected surface layer film thickness and a threshold value.

9. The image forming apparatus according to claim 5, wherein the sensing part includes:

a light emitter that irradiates an outer circumferential surface of the intermediate transfer body with light; and a light receiver that receives reflected light from the intermediate transfer body, and the controller calculates a film thickness of the intermediate transfer body based on a reflectance of the reflected light in accordance with a detection result of the sensing part and determines whether the surface layer film thickness of the intermediate transfer body, which fluctuates immediately after manufacture, is in the stable state based on a comparison between the calculated film thickness of the surface layer of the intermediate transfer body and a threshold value.

10. The image forming apparatus according to claim 5, wherein the sensing part includes:

a light emitter that irradiates an outer circumferential surface of the intermediate transfer body with light; and a light receiver that receives reflected light from the intermediate transfer body, and the controller calculates a film thickness change rate of the intermediate transfer body for a predetermined period based on a reflectance of the reflected light in accordance with a detection result of the sensing part and determines whether the surface layer film thickness of the intermediate transfer body, which fluctuates immediately after manufacture, is in the stable state based on a comparison between the calculated film thickness change rate of the surface layer film thickness of the intermediate transfer body and a threshold value.

11. The image forming apparatus according to claim 1, further comprising an acquirer that acquires environmental information, wherein the controller sets the process condition for the image former based on the acquired environmental information and the detection result.

12. The image forming apparatus according to claim 11, wherein the controller:

determines whether the environmental information acquired by the acquirer has a temperature equal to or higher than a predetermined temperature and a humidity equal to or higher than a predetermined humidity; and when determining that the environmental information has a temperature equal to or higher than the predetermined temperature and a humidity equal to or higher than the predetermined humidity, sets the process condition for the image former based on the detection result.

13. A control method for an image forming apparatus having a part provided in a replaceable manner to be used for image formation, the control method comprising:

detecting a characteristic value of the part;

determining whether the characteristic value of the part, which is not in a stable state within a retention period immediately after manufacture because the characteristic value fluctuates within the retention period immediately after manufacture, is in a stable state based on a comparison between information regarding the characteristic value of the part based on a detection result and a threshold value; and setting a process condition for an image former based on the detected characteristic value when it is determined that the characteristic value of the part is not in the stable state.

14. The control method for an image forming apparatus according to claim 13, wherein the part is an intermediate transfer body including a base layer and a surface layer, in the detecting, a surface layer film thickness of the intermediate transfer body is detected, and it is determined whether the surface layer film thickness of the intermediate transfer body is equal to or less than a threshold value based on a detection result.

* * * * *